United States Patent [19]

Karlsson et al.

[11] Patent Number: 4,663,866

[45] Date of Patent: May 12, 1987

[54] QUICK COUPLING ATTACHMENT FOR OPERATING TOOLS

[76] Inventors: Bengt Karlsson, Box 50, S-771 01 Ludvika; Lauri Niemiaho, Grenadervägen 71, S-777 00 Smedjebacken, both of Sweden

[21] Appl. No.: 834,237

[22] PCT Filed: Apr. 23, 1985

[86] PCT No.: PCT/SE85/00184

§ 371 Date: Dec. 11, 1985

§ 102(e) Date: Dec. 11, 1985

[87] PCT Pub. No.: WO85/04916

PCT Pub. Date: Nov. 7, 1985

[30] Foreign Application Priority Data

Apr. 24, 1984 [SE] Sweden ..... 8402241

[51] Int. Cl.[4] ..... E02F 3/76; B66C 23/00

[52] U.S. Cl. ..... 37/117.5; 414/723; 172/272

[58] Field of Search ..... 37/103, 117.5; 414/723–724, 685–686, DIG. 912; 172/272–274

[56] References Cited

U.S. PATENT DOCUMENTS

| | | | |
|---|---|---|---|
| 3,269,570 | 8/1966 | Wallberg | 414/723 |
| 3,680,724 | 8/1972 | Schaeff | 414/423 |
| 3,794,195 | 2/1974 | Clevenger et al. | 414/723 |
| 4,013,182 | 3/1977 | Pratt et al. | 172/272 X |
| 4,116,346 | 9/1978 | Uchida | 414/723 |
| 4,136,792 | 1/1979 | Wilson | 414/723 |
| 4,187,050 | 2/1980 | Barbee | 37/103 |
| 4,236,329 | 12/1980 | Hetrick | 414/723 |
| 4,242,034 | 12/1980 | Schmitz | 172/272 X |
| 4,311,428 | 1/1982 | Arnold | 37/103 |
| 4,488,850 | 12/1984 | Wernimont | 414/723 |
| 4,545,720 | 10/1985 | Cochran et al. | 414/723 |

FOREIGN PATENT DOCUMENTS

| | | | |
|---|---|---|---|
| 58058 | 8/1982 | European Pat. Off. . | |
| 163849 | 5/1980 | Netherlands | 37/103 |
| WO83/03629 | 10/1983 | PCT Int'Appl. . | |
| 361909 | 10/1970 | Sweden . | |
| 404387 | 10/1978 | Sweden . | |
| 430264 | 4/1982 | Sweden . | |
| 1301910 | 1/1973 | United Kingdom . | |
| 1021722 | 6/1983 | U.S.S.R. | 414/723 |

*Primary Examiner*—E. H. Eickholt

*Attorney, Agent, or Firm*—Witherspoon & Hargest

[57] ABSTRACT

Quick-action attachment for working implements comprising a first coupling part disposed on the working implement or, for example, the operating arm of a working machine and having at least a pair of parallel, undercut, mutually facing surfaces, and comprising a second coupling part are disclosed. On the operating arm of the working machine or on the working implement and having a pair of parallel, bevelled, mutually outwardly facing surfaces are adapted to be brought into engagement with the undercut surfaces of the first coupling part. The second coupling part (4) has a first, stationary, bevelled surface (13) and second bevelled surfaces (20) which are shiftable between a first position permitting the second coupling part (4) to be inserted substantially transversely to the direction of extension of the bevelled surfaces (13, 20) into engagement with the first coupling part (2), and a second position in which the bevelled surfaces (20) of the second coupling (4) have come into steady abutment against the corresponding undercut surface (7) of the first coupling part (2) for locking the working implement (3) to the working machine.

20 Claims, 6 Drawing Figures

QUICK COUPLING ATTACHMENT FOR OPERATING TOOLS

Figure 2:
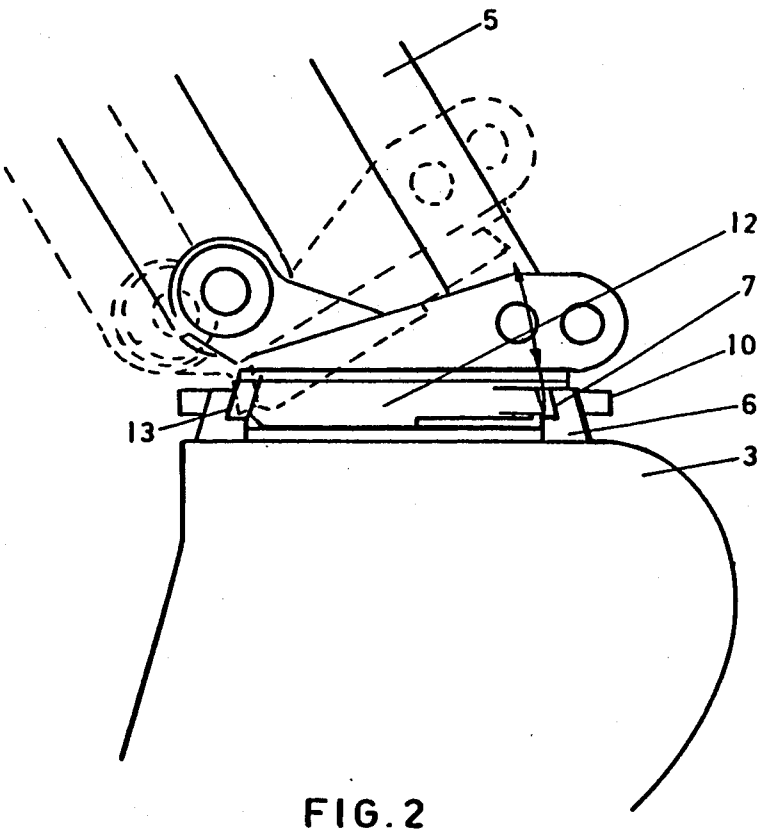

The invention refers to a quick-action attachment for working implements of the type indicated in the preamble of the attached claim 1.

For the purpose of attaching working implements such as dredger shovels, loading shovels, forks and the like to working machines it has long been known to use studs which are introduced through lugs provided on respectively the working implement or the working machine; in addition to the fact that this coupling procedure is very cumbersome and even risky, there is also a great risk that the lugs in some of the parts will be deformed so that insertion of the studs no longer will be possible.

In order to eliminate the serious drawbacks of this kind of conventional attachment constructions have been proposed which comprise undercut guide bars arranged in angular relation to each other. These guide bars are ordinarily permanently provided on a dredger shovel or the like and the coupling is obtained by providing an attachment plate at the outermost part of the arm of a digging machine, said attachment plate having bevelled edges which also are disposed angularly in relation to each other, said attachment plate being laterally introduced into the groove formed by the undercut guide bars. After introduction of the attachment plate to the bottom of the groove it is locked hydraulically, for example by moving pins in an outward direction into contact with abutments provided in connection with the guide bars.

The inconvenience inherent with these known constructions consists in that it is relatively complicated to laterally introduce the attachment plate in a correct way into the groove without tilting and jamming it in the groove. Among other disadvantages may be mentioned that the locking pins have a relatively exposed position and may be damaged during work whereby disconnection or renewed coupling may be obstructed or rendered impossible, that a certain self-locking by wedged-action may arise between the attachment plate and the groove causing difficulties in removing the working implement for exchange, and that the sliding movement between the attachment plate and the groove may involve wear of these parts in particular if dirt and stones are introduced into the groove. Such wear often causes the coupling to become loose after a period of use so that a correct coupling no longer can be guaranteed.

There is further known an arrangement for mounting a crane jib to a vehicle comprising an attachment plate having bevelled side edges mounted on the vehicle and a "slide frame" provided on the crane jib, this slide frame having undercut side edges co-operating with the bevelled edges of the attachment plate. The slide frame is adapted to slide on the attachment plate and to be hydraulically locked thereon in an optional position. Both the side edges of the attachment and the undercut surfaces of the slide are mutually parallel. However, this arrangement is in the first place conceived for optional positioning of the crane jib along the attachment plate and could not operate as quick-action attachment because the insertion of the slide frame on to the attachment plate would be too complicated due to the exact tolerance required between the co-operating surfaces.

A further problem encountered for example in connection with the coupling of a dredger shovel to a digging machine arm is caused by the fact that it is often desirable to be able to mount the shovel both for deep and high excavation, which means with the dredger shovel mounted in two alternative positions at 180° angular distance in relation to each other. To our knowledge this is not possible with any of the previously known quick-action couplings.

Thus, it is the purpose of the present invention to provide a quick-action attachment for working implements of the type mentioned initially which eliminates the problems discussed above and which permits a quick and reliable attachment of the working implement in at least two different positions.

This purpose is achieved with the aid of a quick-action attachment of the type indicated in the attached claims, these claims also indicating the particular characteristic features of the invention.

Figure 1:
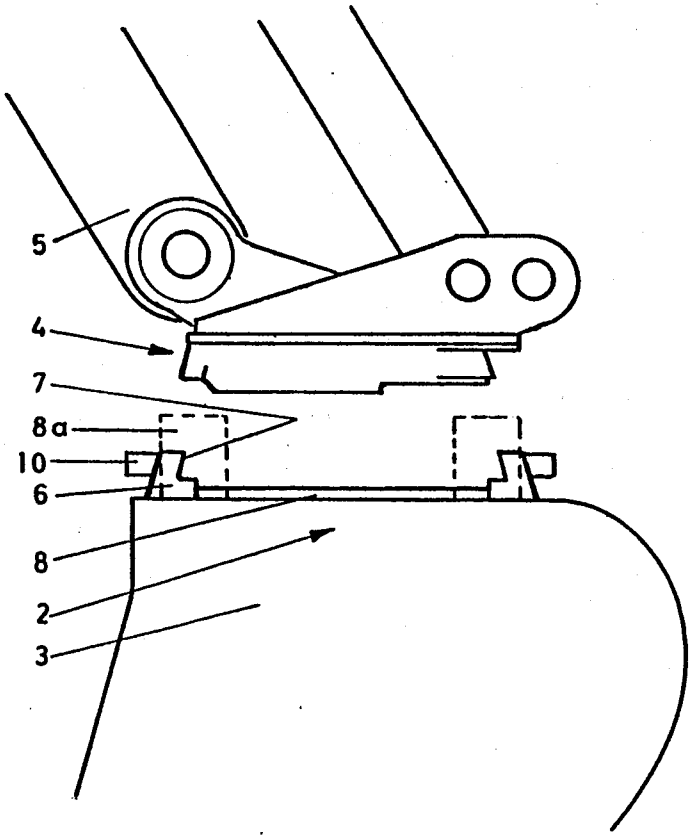
Figure 3:
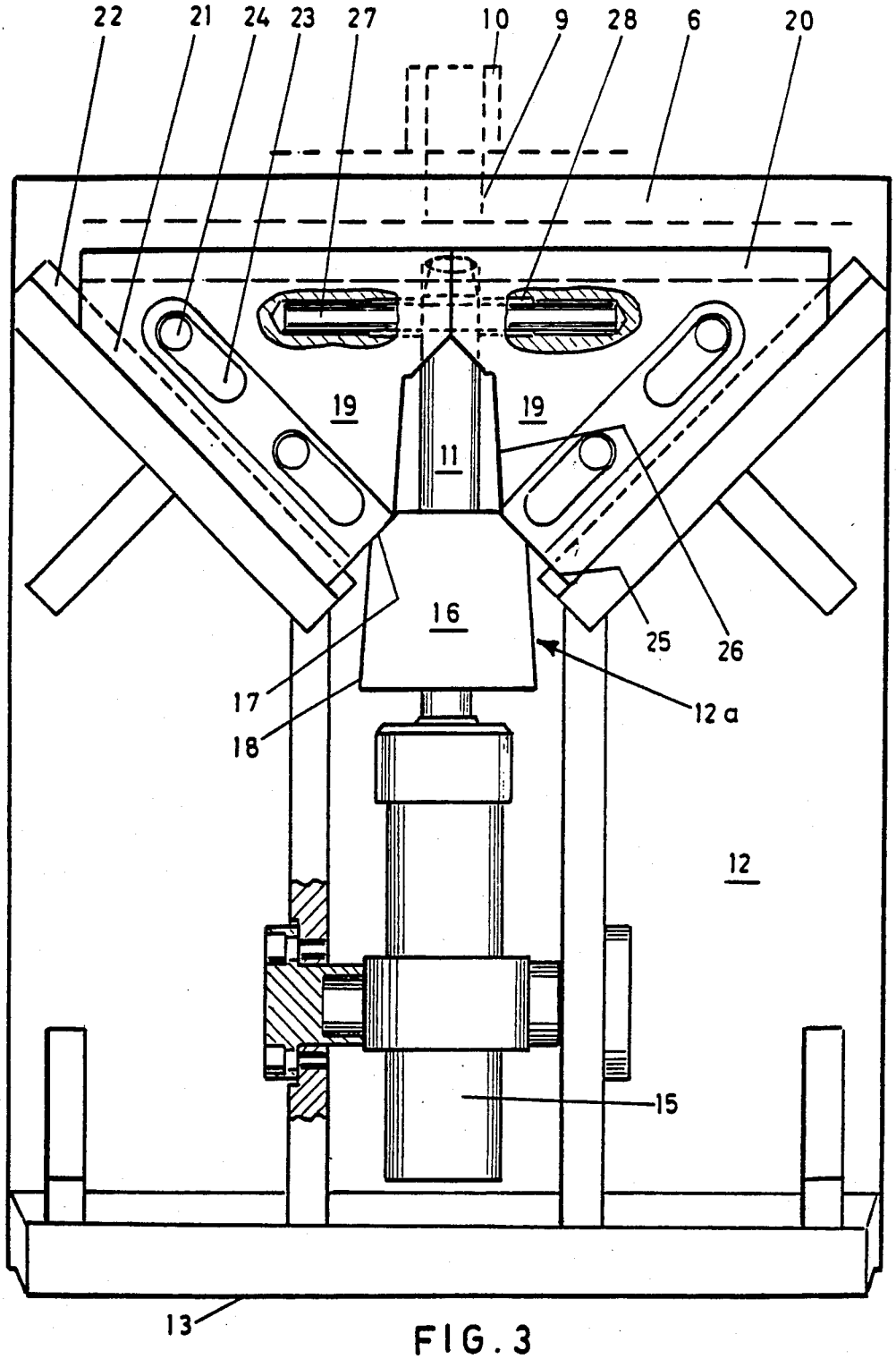
Figure 4:
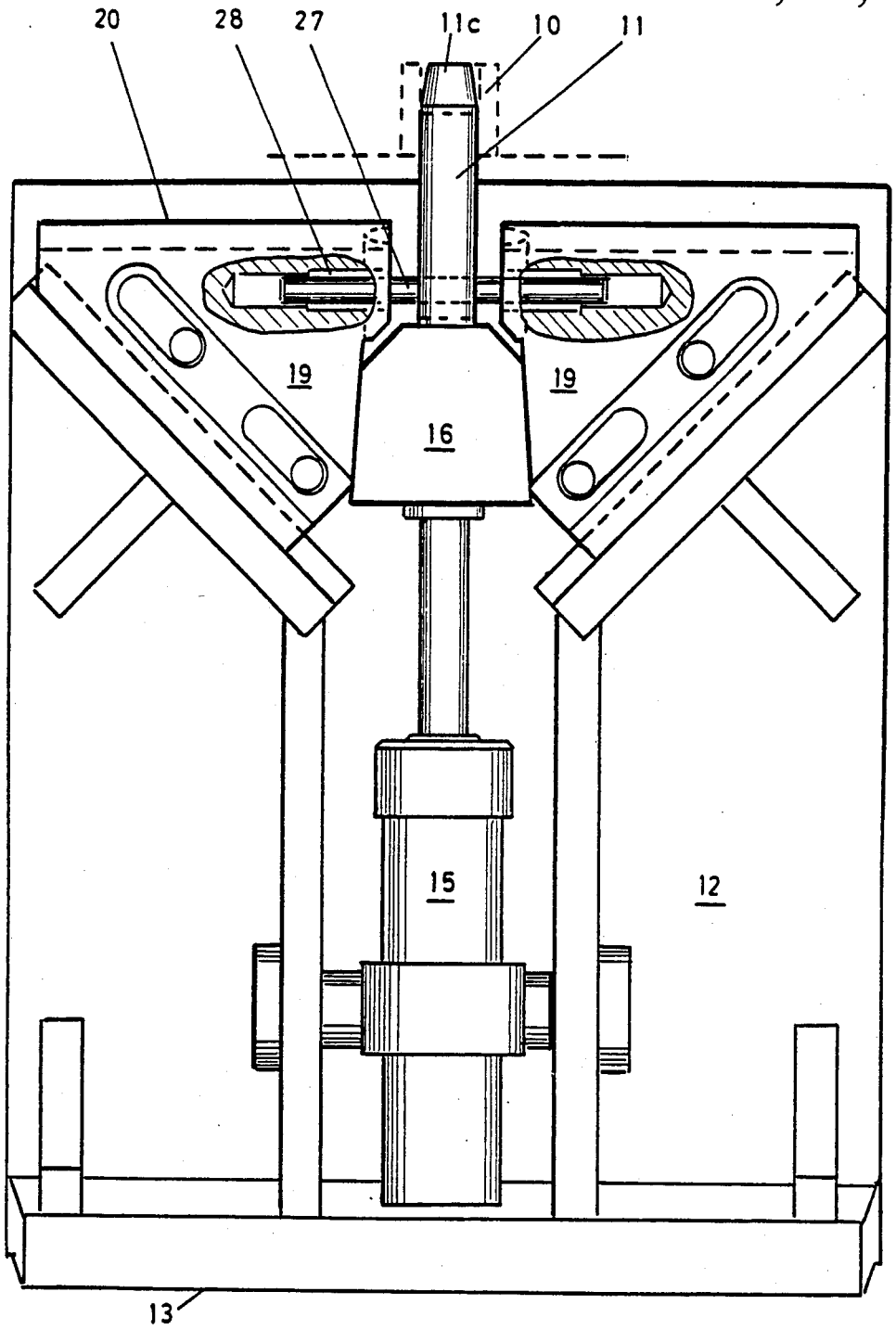
Figure 5:
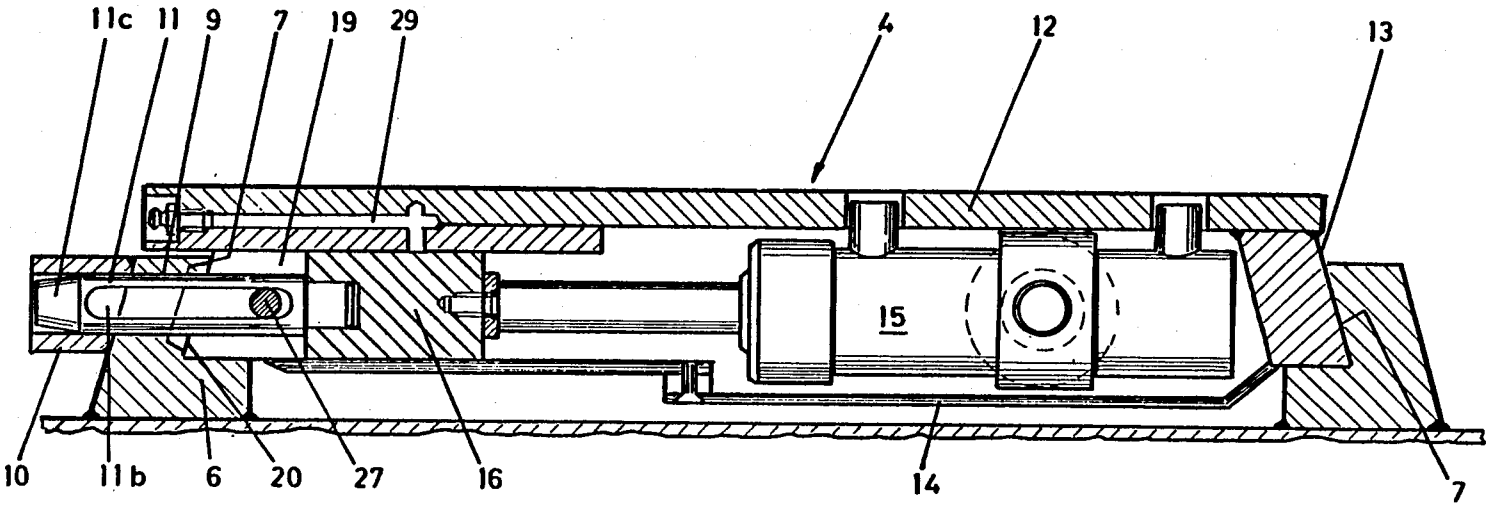
Figure 6:
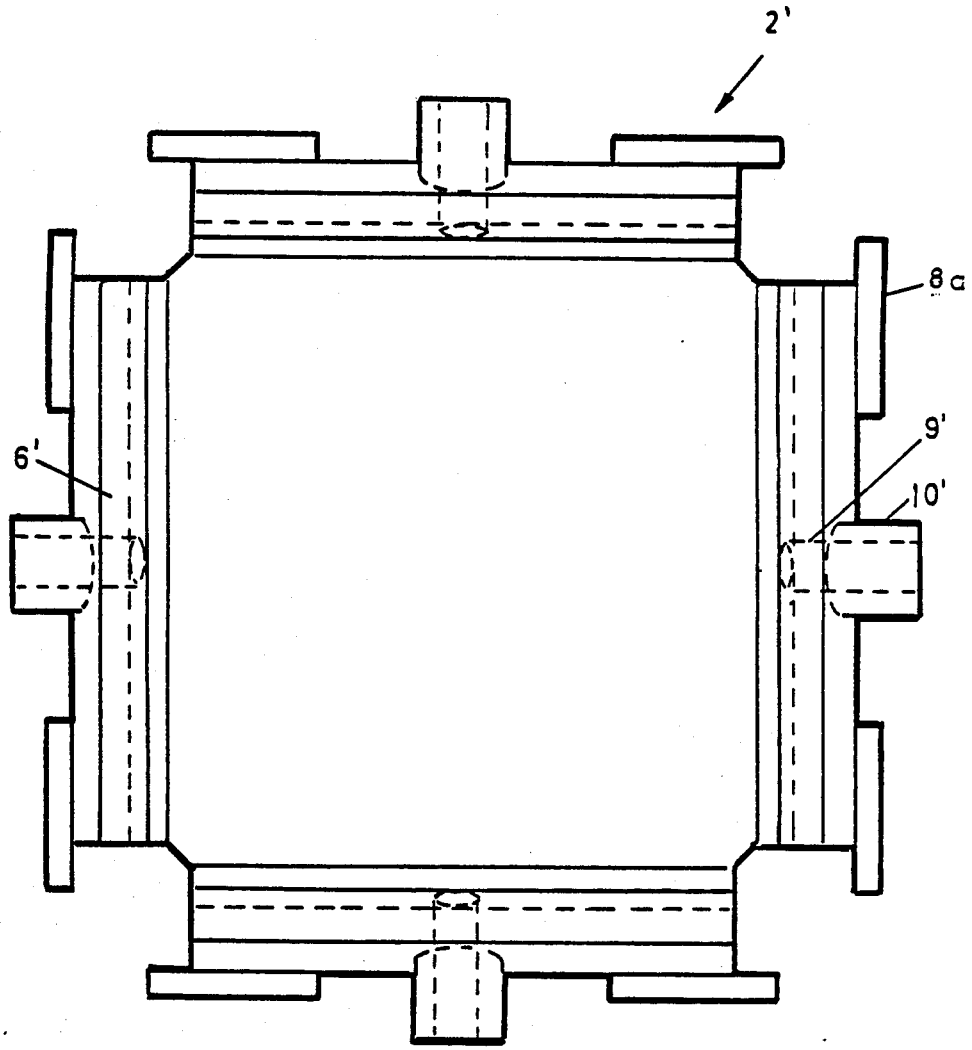

The invention will be described in greater detail hereafter by reference to the attached drawings in which FIGS. 1 and 2 schematically show the assembly of the second coupling part which, for example, is mounted on the operating arm of a working machine with the first coupling part mounted on the working implement, FIGS. 3 and 4 show the locking mechanism in two different positions during the locking procedure, FIG. 5 is a section through the locking mechanism according to FIGS. 3 and 4, and FIG. 6 shows an alternative embodiment of the first coupling part.

Initially, it should be emphasized that the quick-action attachment according to the invention is useful for the attachment of both dredger shovels, loading shovels and forks as well as other possible working implements in all types of working machines such as digging machines, front-loaders, tractors and the like.

As appears from the drawings the quick-action attachment 1 according to the present invention basically comprises a stationary, first coupling part 2 mounted on the working implement 3 and an expandable second coupling part 4 mounted on the working machine 5.

In the embodiment shown in FIGS. 1–5 the stationary coupling part 2 comprises two parallel attachment bars 6 which are undercut on their mutually facing surfaces 7 to form together substantially a dove-tailed groove. The attachment bars 6 may be directly attached to the working implement 3 but are suitably attached to a frame 8 which in turn is attached to the working implement. This facilitates mounting in view of the fact that the attachment bars should be strictly parallel with each other to guarantee a reliable locking. In connection with the ends of the attachment bars guide plates **8*a* are provided to facilitate the insertion of the expandable second coupling part 4 in correct position. (Two guide plates 8*a* are shown in broken lines in FIG. 1 but are eliminated for the sake of clearness in FIG. 2**).

In each attachment bar 6 a through hole 9 is centrally provided, extending from the undercut surface 7 to the opposite side of the attachment bar. As a continuation of the through hole 9 a sleeve 10 is provided, the through hole and the sleeve being adapted to receive a centering pin 11 on the expandable coupling part 4. It should be appreciated that the stationary coupling part 2 in a more simplified embodiment when turning of the working implement is not required, can be provided with the through hole 9 and the sleeve 10 in only one of the attachment bars 6. In this embodiment it may even be sufficient to provide guide plates 8*a* only at the ends of the attachment bar which has not been provided with any through hole.

The expandable coupling part 4 basically comprises an attachment plate 12 which at its one edge surface has a bevelled surface 13, the bevelling being made at an angle agreeing with the angle of the undercut surface of the attachment bars 6. In its underside the attachment plate 12 is recessed to receive the locking mechanism 12*a* of the quick-action attachment, the recess being covered by a protective plate 14 (compare FIG. 5).

In FIGS. 3 and 4 the attachment plate is shown from below with the protective plate 14 removed. It will be seen that the locking mechanism 12*a* comprises an hydraulic cylinder 15 which is attached to the attachment plate 12 and which suitably is connected to the hydraulic system of the working machine via holes in the attachment plate. For reasons of security the hydraulic cylinder is suitably connected via a protective valve (not shown) which in case of a drop-out of the hydraulic system of the working machine (for example due to hose rupture) prevents hydraulic oil to be discharged from the cylinder when it is in its locking position.

The hydraulic cylinder 15 is provided with a piston rod the free end of which carries a central wedge 16 having first wedge surfaces 17 extended at a comparatively large angle in relation to each other and second wedge surfaces 18 extended at a relatively small angle in relation to each other. At the forward end of the central wedge 16 adjacent the first wedge surfaces 17 the centering pin 11 is mounted, provided with an oblong hole 11*b* and a tapering forward end 11*c*.

During operation of the hydraulic cylinder 15 the central wedge 16 is adapted to co-operate with two side wedges 19 which with one of their edge portions 20 form the second shiftable wedge surface of the attachment plate 12, which surface is provided with a bevel corresponding to that of surface 13. The side wedges 19 are adapted to slide with a guide surface 21 against a corresponding guide surface 22 in the recess of the attachment plate 12. Preferably these guide surfaces 21 and 22 are also bevelled and undercut respectively. By means of oblong holes 23 the side wedges 19 are slidable journalled on socket head cut screws 24 mounted in threaded holes in the attachment plate.

For co-operation with the wedge surfaces 17, 18 of the central wedge the side wedges are provided with first wedge surfaces 25 extending at a comparatively large angle and second wedge surfaces 26 extending at a relatively small angle in relation to each other.

For return movement the side wedges 19 are functionally connected to each other with the aid of a follower pin 27 which is slidably mounted in slide bushings 28 in the side wedges and which extends through the oblong hole 11*b* in the centering pin 11.

In order to guarantee a reliable function of the lock mechanism a plurality of lubricating ducts 29 are provided through which lubricant may be introduced between the mutually co-operating surfaces in the lock mechanism.

In FIG. 6 there is shown an alternative embodiment of the first, stationary coupling part 2'. This embodiment is particularly intended to be used when it is desirable to mount a working implement in four alternative positions in order to achieve as great a versatility as possible. In this embodiment the first coupling part is provided with four attachment bars 6' arranged as the sides of a square and having centrally on each attachment bar a through hole 9' and sleeve 10'. Hereby the attachment plate can be placed in four different positions in relation to the stationary coupling part.

The quick-action attachment according to the invention operates in the following way:

When a working implement is to be coupled with for example the operating arm of a working machine, the operating arm together with the attachment plate 12 mounted thereon, as appears from FIGS. 1 and 2, is moved obliquely towards the stationary coupling part 2 causing the stationary bevelled surface 13 of the attachment plate initially to be introduced against the undercut surface 7 on the one attachment bar 6 on the first coupling part 2. As shown in FIG. 2 the spacing between the stationary bevelled surface 13 and the bevelled surfaces 20 on the side wedges 19, in the fully retracted starting position of the wedges 19, is sufficiently large to enable the attachment plate, after insertion of the stationary bevelled surface 13 in the way as described above, to be swung down to the position shown with solid lines in FIG. 2 in co-planar relation with the first coupling part.

After assemblage of the coupling parts as described above the hydraulic cylinder 15 is activated with the aid of a valve, not shown, to extend the piston rod. Hereby the first wedge surfaces 17 of the central wedge are caused to abut against the first wedge surfaces 25 of the side wedges, whereby the side wedges are shifted in a oblique sideward direction. In a suitable embodiment—it being understood that the dimensioning may vary to a great extent between different applications—the spacing between the bevelled surfaces 20 of the side wedges 19 and the undercut surface of the corresponding attachment bar 6 in the starting position is about 20 mm, and due to the fact that the angle between the first wedge surfaces 17 and 25 respectively on the central wedge and on the side wedges respectively is comparatively large, the side wedges will initially be shifted outwardly with relatively high speed. After having been shifted so far that their bevelled surfaces 20 have been displaced about 16–17 mm in a straight outward direction, the second wedge surfaces 18, 26 will abut each other and because the angle between these second wedge surfaces is considerably smaller, the side wedges will be shifted during the last part of their movement at a relatively slow rate and with a great force. Thanks to this small angle, a certain self-locking action will also be obtained between the central wedge and the side wedges when the bevelled surfaces 20 of the side wedges have come into tight abutment against the undercut surface 7 of the attachment bar 6. Hereby additional locking security is obtained even if leakage should occur in the hydraulic cylinder. Normally the hydraulic cylinder will be under full pressure during the entire locking procedure. Thereby the locking mechanism automatically takes up any play that may appear during work. When the central wedge is shifted outwardly, the centering pin 11 will be introduced into the hole 9 in the attachment bar 6 and, due to the taper of its outer end 11*c*, it will, if necessary, achieve a centering of the coupling parts in relation to each other. The sleeve 10 which is provided on the attachment bar is intended to protect the centering pin against damage.

During detachment the hydraulic cylinder is activated by means of the valve, not shown, to retract the piston rod. During the return movement, the follower pin 27 will contact the forward end of the oblong hole 11*b* in the centering pin 11, whereby also the side wedges 19 are returned to their starting positions. The mutual emplacement of the follower pin and the oblong hole 11*b* is so chosen that the pin 27 will contact the end of the hole only when the central wedge has been returned so far that the side wedges may be freely returned to the starting position. Thereafter the attachment plate 12 may be removed from the attachment bars and directly re-coupled with another working implement.

Even if the present invention has been described above by particular reference to a suitable embodiment, it should be appreciated that an expert may perform changes and modifications without deviating from the basic idea of the invention. Thus it might, for example, be possible to provide a different type of drive for the locking mechanism, for example a manually operated screw-nut drive. In such a case it should also be possible to provide the attachment plate on the working implement and the attachment bars on the working machine. The co-operating surfaces on the first and second coupling parts might also be designed with another suitable cross-section profile, different from the shown profile. Thus, the range of protection of the invention shall only be limited by the attached claims.

We claim:

1. Quick-action attachment for working implements comprising a first coupling part disposed on the working implement or, for example, the operating arm of a working machine and having at least a pair of parallel, undercut, mutually facing surfaces, and comprising a second coupling part disclosed, for example, on the operating arm of the working machine or on the working implement and having a pair of parallel, bevelled, mutually outwardly facing surfaces adapted to be brought into engagement with the undercut surfaces of the first coupling part, characterized in that the second coupling part (4) has a first, stationary, bevelled surface (13) and second bevelled surfaces (20) which are shiftable between a first position permitting the second coupling part (4) to be inserted substantially transversely to the direction of extension of the bevelled surfaces (13, 20) into engagement with the first coupling part (2), and a second position in which the bevelled surfaces (20) of the second coupling (4) have come into steady abutment against the corresponding undercut surface 7 of the first coupling part (2) for locking the working implement (3) to the working machine.

2. Quick-action attachment as claimed in claim 1, characterized in that the undercut surfaces (7) of the first coupling part (2) and the bevelled surfaces (13, 20) of the second coupling part (4) are mutually undercut and bevelled respectively with the same angle whereby an alternative coupling in at least two different positions is permitted.

3. Quick-action attachment as claimed in claim 1, characterized in that the first coupling part (2') has two pairs of mutually parallel undercut surfaces (7') disposed on the same mutual spacing from each other so that the undercut surfaces substantially form the sides of a square.

4. Quick-action attachment according to claim 1, characterized in that the shiftable bevelled surface (20) of the second coupling part (4) is constituted by two side wedges (19) which are slidable against guide surfaces (22) in the second part (4).

5. Quick-action attachment as claimed in claim 4, characterized in that the side wedges (19) are actuated by a manoeuvrable central wedge (16) which by means of first wedge surfaces (17, 25) of the central wedge (16) and the side wedges (19) respectively initially comparatively quickly shifts the side wedges towards their extended positions and which by means of second wedge surfaces (18, 26) of the central wedge and the side wedges respectively during the final phase of the movement shifts the side wedges relatively slowly and with great force towards their final positions.

6. Quick-action attachment as claimed in claim 5, characterized in that the second wedge surfaces (18, 26) of the central wedge (16) and the side wedges (19) respectively extend at such a small angle in relation to each other that a self-locking action is obtained for the central wedge in the fully extended position.

7. Quick-action attachment as claimed in claim 5, characterized in that the central wedge (16) at its forward end in the shifting direction is provided with a centering pin (11) which in the extended position enters into a corresponding hole (9) provided in at least one of the undercut surfaces (7) of the first coupling part of establish a centering and additional security.

8. Quick-action attachment as claimed in claim 7, characterized in that for the purpose of returning the side wedges (19) to their retracted starting positions a follower pin (27) is provided which with its opposed ends is slidably received (28) in either side wedge and which freely extends through an oblong recess **(11*b*) in the centering pin (11) of the central wedge (16)** so that during return of the central wedge and thereby of the centering pin the follower pin will abut the forward end of the recess to return the side wedges.

9. Quick-action attachment as claimed in claim 6, characterized in that the forward free end **(11*c*) of the centering pin (11)** is tapered to permit a guiding action to the correct position.

10. Quick-action attachment as claimed in claim 1, characterized in that guide plates **(8*a*) are provided in connection with the ends of at least two of the undercut surfaces (7) of the first coupling part (2)**.

11. Quick-action attachment as claimed in claim 2, characterized in that the first coupling part (2') has two pairs of mutually parallel undercut surfaces (7') disposed on the same mutual spacing from each other so that the undercut surfaces substantially form the sides of a square.

12. Quick-action attachment according to claim 2, characterized in that the shiftable bevelled surface (20) of the second coupling part (4) is constituted by two side wedges (19) which are slidable against guide surfaces (22) in the second part (4).

13. Quick-action attachment according to claim 3, characterized in that the shiftable bevelled surface (20) of the second coupling part (4) is constituted by two side wedges (19) which are slidable against guide surfaces (22) in the second part (4).

14. Quick-action attachment as claimed in claim 6, characterized in that the central wedge (16) at its forward end in the shifting direction is provided with a centering pin (11) which in the extended position enters into a corresponding hole (9) provided in at least one of the undercut surfaces (7) of the first coupling part to establish a centering and additional security.

15. Quick-action attachment as claimed in claim 7, characterized in that the forward free end **(11*c*) of the centering pin (11)** is tapered to permit a guiding action to the correct position.

16. Quick-action attachment as claimed in claim 8, characterized in that the forward free end (11*c*) of the centering pin (11) is tapered to permit a guiding action to the correct position.

17. Quick-action attachment as claimed in claim 2, characterized in that guide plates (8*a*) are provided in connection with the ends of at least two of the undercut surfaces (7) of the first coupling part (2).

18. Quick-action attachment as claimed in claim 3, characterized in that guide plates (8*a*) are provided in connection with the ends of at least two of the undercut surfaces (7) of the first coupling part (2).

19. Quick-action attachment as claimed in claim 7, characterized in that guide plates (8*a*) are provided in connection with the ends of at least two of the undercut surfaces (7) of the first coupling part (2).

20. Quick-action attachment as claimed in claim 8, characterized in that guide plates (8*a*) are provided in connection with the ends of at least two of the undercut surfaces (7) of the first coupling part (2).

* * * * *